US012420331B2

(12) United States Patent
Jandt et al.

(10) Patent No.: US 12,420,331 B2
(45) Date of Patent: Sep. 23, 2025

(54) FORMING METHOD AND FORMING MACHINE FOR PRODUCING A HELICAL TOOTHING OF A CYLINDRICAL WORKPIECE BY EXTRUSION

(71) Applicant: FELSS Systems GmbH, Koenigsbach-Stein (DE)

(72) Inventors: Max Olaf Jandt, Keltern (DE); Maximilian Ludwig, Maulbronn-Schmie (DE); Nadezda Missal, Schwieberdingen (DE); Serjosha Heinrichs, Oberderdingen (DE); Sascha Voegele, Kaempfelbach (DE)

(73) Assignee: FELSS Systems GmbH, Koenigsbach-Stein (DE)

( * ) Notice: Subject to any disclaimer, the term of this patent is extended or adjusted under 35 U.S.C. 154(b) by 360 days.

(21) Appl. No.: 18/143,641

(22) Filed: May 5, 2023

(65) Prior Publication Data

US 2023/0398598 A1 Dec. 14, 2023

(30) Foreign Application Priority Data

Jun. 9, 2022 (EP) ..... 22178023

(51) Int. Cl.
*B21K 1/30* (2006.01)
*B21C 23/03* (2006.01)
(Continued)

(52) U.S. Cl.
CPC ..... *B21K 1/305* (2013.01); *B21C 23/035* (2013.01); *B21C 23/18* (2013.01); *B21C 25/02* (2013.01);
(Continued)

(58) Field of Classification Search
CPC ..... B21K 1/30; B21K 1/305; B21C 23/035; B21C 23/18; B21J 5/12; Y10T 29/49474
See application file for complete search history.

(56) References Cited

U.S. PATENT DOCUMENTS 5,465,597 A 11/1995 Bajraszewski et al.
6,212,929 B1 4/2001 Binhack
(Continued)

FOREIGN PATENT DOCUMENTS

CN 103447441 B 6/2015
DE 10 2006 037 091 B3 9/2007
(Continued)

OTHER PUBLICATIONS

Japanese Office Action in Application No. 2023-094735, Dated Apr. 2, 2025 (with English translation).
(Continued)

*Primary Examiner* — Jared O Brown
(74) *Attorney, Agent, or Firm* — Collard & Roe, P.C.

(57) ABSTRACT

In the context of a forming method for producing a helical toothing of a cylindrical workpiece by extrusion, a relative movement of a forming tool and of a workpiece blank carried out in a peripheral direction of the forming tool and of the workpiece blank is superimposed on an axial forming movement of the forming tool and of the workpiece blank. Due to a forming relative movement of the forming tool and of the workpiece blank resulting from the mutual superimposition of the axial forming movement and the forming movement in the peripheral direction, the helical toothing of the workpiece is produced on the workpiece blank, in that the forming tool engages, with a shaping helical toothing, in the workpiece blank during the resulting forming relative movement. A forming machine is designed to carry out the aforementioned method.

15 Claims, 4 Drawing Sheets

(51) Int. Cl.

| | |
|---|---|
| ***B21C 23/18*** | (2006.01) |
| ***B21C 25/02*** | (2006.01) |
| ***B21C 25/04*** | (2006.01) |
| ***B21C 31/00*** | (2006.01) |
| ***B21J 5/12*** | (2006.01) |

(52) U.S. Cl.
CPC ..... *B21C 25/04* (2013.01); *B21C 31/00* (2013.01); *B21J 5/12* (2013.01); *Y10T 29/49474* (2015.01)

(56) References Cited

U.S. PATENT DOCUMENTS

| | | | | |
|---|---|---|---|---|
| 8,091,400 | B2 | 1/2012 | Binhack | |
| 8,240,179 | B2 | 8/2012 | Grupp | |
| 2009/0188292 | A1* | 7/2009 | Binhack | B21C 31/00 72/271 |
| 2010/0083723 | A1* | 4/2010 | Szuba | B21C 23/14 72/260 |

FOREIGN PATENT DOCUMENTS

| | | | | |
|---|---|---|---|---|
| DE | 10 2009 045 231 | A1 | 4/2010 | |
| DE | 102017001211 | A1 | 8/2018 | |
| JP | 2001514969 | A | 9/2001 | |
| JP | 2003062636 | A | 3/2003 | |
| JP | 2010500175 | A | 1/2010 | |
| WO | 2006/024505 | A1 | 3/2006 | |
| WO | WO-2018146262 | A1 * | 8/2018 | B21C 1/18 |

OTHER PUBLICATIONS

European Search Report dated Dec. 8, 2022 in European Application No. 22178023.2 with English translation of relevant parts.

"GFB ReZahn Projektdarstellung"—Powerpoint Presentation entitled: "Ressourceneffiziente Herstellung einsatzfähiger Zahnräder durch Kaltmassivumformung" (Resource-efficient production of ready-to-use gears by means of cold forging); Summary of a lecture held at the "2nd Green Factory Bavaria Kolloquium 2015" and published in the conference script for that colloquium in Oct. 2015 (ISBN 978-3-00-050523-2), with concise explanation in English, total of 3 pages.

* cited by examiner

FORMING METHOD AND FORMING MACHINE FOR PRODUCING A HELICAL TOOTHING OF A CYLINDRICAL WORKPIECE BY EXTRUSION

CROSS REFERENCE TO RELATED APPLICATIONS

Applicant claims priority under 35 U.S.C. § 119 of European Application No. 22178023.2 filed Jun. 9, 2022, the disclosure of which is incorporated by reference.

BACKGROUND OF THE INVENTION

1. Field of the Invention

The invention relates to a forming method for producing a helical toothing of a cylindrical workpiece by extrusion, wherein a forming tool, provided with a shaping helical toothing, and a cylindrical workpiece blank are moved relative to one another in an axial direction with an axial forming movement, and wherein, due to the axial forming movement of the forming tool and of the workpiece blank, the helical toothing of the workpiece is produced on the workpiece blank, in that the forming tool engages, with the shaping helical toothing, in the workpiece blank during the axial forming movement of the forming tool and of the workpiece blank.

The invention also relates to a forming machine for carrying out the aforementioned method, and a computer program for controlling the forming machine during the execution of the method.

2. Description of the Related Art

Components having a helical toothing are widely used. For example, in drive technology, helically-toothed wheels or drive shafts having externally or internally helically-toothed shaft portions are common. Different gear geometries are provided, depending upon the specific application.

As category-defining prior art, what is referred to as the "Samanta method" is known. The Samanta method is used for manufacturing helically-toothed gears. In this method, gear wheel blanks are pressed successively with a straight axial movement through a die provided with a shaping internal helical toothing. Frequently, however, the toothings produced using the Samanta method require post-processing, since the toothing quality is not sufficient for the relevant application.

SUMMARY OF THE INVENTION

The object of the present invention is to enable the manufacture of components having high-quality helical toothings.

According to the invention, this object is achieved by a forming method for producing a helical toothing of a cylindrical workpiece by extrusion. wherein a forming tool provided with a shaping helical toothing and a cylindrical workpiece blank are moved relative to one another in an axial direction with an axial forming movement, and the helical toothing of the workpiece is produced on the workpiece blank on account of the axial forming movement of the forming tool and of the workpiece blank. The forming tool engages with the shaping helical toothing in the workpiece blank during the axial forming movement of the forming tool and of the workpiece blank.

The forming movement which the forming tool and the workpiece blank carry out relative to one another in the peripheral direction thereof is superimposed on the forming movement by which a forming tool, provided with a shaping toothing, and a workpiece blank to be machined are moved relative to one another in the axial direction. The parameters of the forming process, e.g., the speeds of the relative movements of the forming tool and workpiece blank, to be matched to one another and produced by means of the feed drive and the rotary drive of the forming machine according to the invention, can be defined empirically, as a function of the specific application. The process parameters to be defined are influenced, for example, by the material properties of the workpiece blank to be formed and by the geometry of the helical toothing to be produced. The speed ratio of the axial relative speed of the forming tool and workpiece blank, and the relative speed of the forming tool and workpiece blank in the peripheral direction, can also be calculated on the basis of the helix angle of the shaping helical toothing and the workpiece-side helical toothing.

The forming method according to the invention and the forming device according to the invention enable high-quality manufacture of different gear geometries by extrusion. For instance, involute gear teeth on gear wheels can also be produced in high quality, such as splines for form-fitting shaft-hub connections.

Conventional controllable drive types are suitable for the feed drive and the rotary drive of the forming machine according to the invention.

The direction of movement of the forming tool and of the workpiece blank resulting from the axial movement and the movement in the peripheral direction can be reversible during the forming process and after its completion. For this reason, the forming method according to the invention and the forming machine according to the invention are also suitable, for example, for creating external helical toothings on stepped shafts.

The computer program according to the invention serves for the digital control of the forming machine according to the invention when carrying out the forming method according to the invention.

Variants of the forming method according to the invention and the forming machine according to the invention, are distinguished by a particularly high machining quality. In what is known as "recursive" forming of the type according to the invention, helical toothing on a workpiece is created in sections over a forming length. A forming movement performed by the forming tool and the workpiece blank, relative to one another, is followed by a backward stroke, in which the forming tool and the workpiece blank are moved relative to one another counter to the direction of the preceding forming movement in such a way that the shaping toothing comes to lie in an already formed region of the workpiece blank. This is followed by a further forming relative movement of the forming tool and workpiece blank. The basic mode of operation of the recursive axial forming is described, for example, in DE 10 2006 037 091 B3, the disclosure of which is herein incorporated by reference.

In an advantageous embodiment of the invention, external helical teeth are produced by simultaneously moving relative to one another, in the axial and peripheral direction, a workpiece blank to be formed and a forming die positioned thereon and provided with a shaping internal helical toothing.

In a further advantageous embodiment of the invention, in order to produce an internal helical toothing, a workpiece blank to be formed and a forming mandrel which axially enters a cylindrical opening of the workpiece blank and which is provided with a shaping helical toothing on its outer side are moved relative to one another with an axial movement and a movement in the peripheral direction superimposed thereon. For example, a hollow cylindrical shaft blank for an internally helically-toothed hollow shaft is possible as the workpiece blank to be machined. Due to the possibility, which exists according to the invention, of reversing the direction of the resulting forming movement of the forming tool and workpiece blank, the method according to the invention and the forming machine according to the invention also allow for the creation of a helical toothing on the axial wall of cylindrical blind openings. After completion of the wall toothing, the forming mandrel is removed from the interior of the blind opening by the aforementioned reversal of the movement direction.

In order to produce the component, extending in the peripheral direction, of the resulting forming relative movement of the forming tool and of the workpiece blank to be formed, various options are available according to the invention, which can be implemented alternatively or together in the case of the invention.

According to one embodiment, one of the forming partners, of the forming tool and the workpiece blank, is freely rotatable in the peripheral direction, and the other forming partner is fixed in a non-rotatable manner in the peripheral direction. The forming movement of the forming tool and of the workpiece blank in the peripheral direction is produced due to the axial forming movement of the forming tool and of the workpiece blank as a result of a corresponding dimensioning of the helix angle of the shaping helical toothing on the forming tool. In this case, the forming tool together with the feed drive forms the rotary drive of the forming machine according to the invention.

The helix angle of the helical toothing on the workpiece to be manufactured, and consequently also the helix angle of the shaping helical toothing on the forming tool, is defined for the specific application. If the specific application allows some leeway in the dimensioning of the helix angle, a value can possibly be selected for the helix angle of the shaping helical toothing on the forming tool, which value is particularly suitable for carrying out the method according to the invention. Factors which have an effect on the suitability of a helix angle of the shaping helical toothing for carrying out the method according to the invention are, for example, the material pairing of the shaping helical toothing and the workpiece blank, and the resulting frictional conditions on the contact surface of the shaping helical toothing and the workpiece blank.

The component, extending in the peripheral direction, of the resulting forming relative movement of the forming tool and of the workpiece blank is generated by motorized drive of at least one of the forming partners. In particular, electrical and hydraulic drives are conceivable according to the invention. Alternatively, however, a mechanical linkage of the axial relative movement of the forming tool and the workpiece blank with the relative movement of the forming tool and the workpiece blank carried out in the peripheral direction is also possible.

In the case of the method and machine according to the invention, the forming movement of the forming tool and of the workpiece blank in the peripheral direction is optionally generated on account of a corresponding dimensioning of the helix angle of the shaping helical toothing on the forming tool or in addition by the motorized drive of at least one of the forming partners. For this purpose, the rotational movement state of the forming partner rotatable in the peripheral direction is monitored. If, for example, the peripheral relative movement of the forming tool and of the workpiece blank to be formed is initially produced due to the axial relative movement of the forming partners and due to a corresponding dimensioning of the helix angle of the shaping helical toothing of the forming tool, the motorized drive of the drivable forming partner can be switched on, for example, when it is determined during the monitoring of the rotational movement state of the rotatable forming partner that the rotational movement of the rotatable forming partner is appreciably delayed or even completely comes to rest. When an external helical toothing is produced on a workpiece by means of a forming die positioned on the workpiece, an increase in the outer diameter of the workpiece blank occurring due to manufacturing tolerances, for example, may be responsible for such a delay or termination of the rotational movement of the rotatable forming partner.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
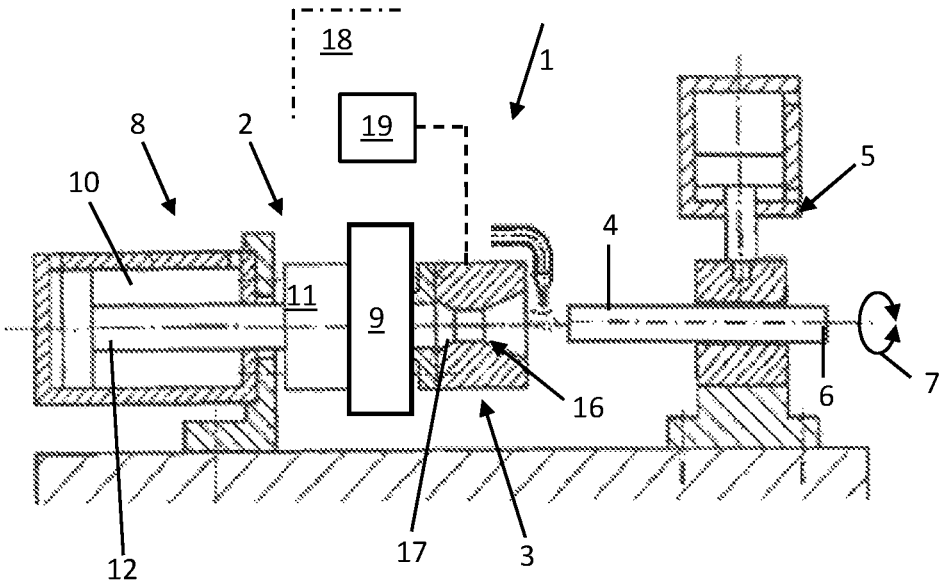
FIG. 1 shows a forming machine for producing an external helical toothing of a cylindrical workpiece.

According to FIG. 1, a forming machine 1 has a forming drive 2, by means of which a forming die 3 can be moved relative to a workpiece blank 4 with a forming movement. In the example shown, the workpiece blank 4 is a hollow shaft blank, made of steel, for manufacturing a drive shaft for motor vehicles. The workpiece blank 4 is clamped by means of a clamping unit 5 of the forming machine 1, and is thereby stationary in an axial direction along an axis 6 and in a peripheral direction 7.

The forming drive 2 of the forming machine 1 comprises a feed drive 8, and a rotary drive 9 shown in a highly schematic manner in FIG. 1. The feed drive 8 has a piston-cylinder unit 10 and a frequency generator 11, which is arranged between a piston rod 12 of the piston-cylinder unit 10 on the one hand, and the rotary drive 9 on the other.

Figure 2:
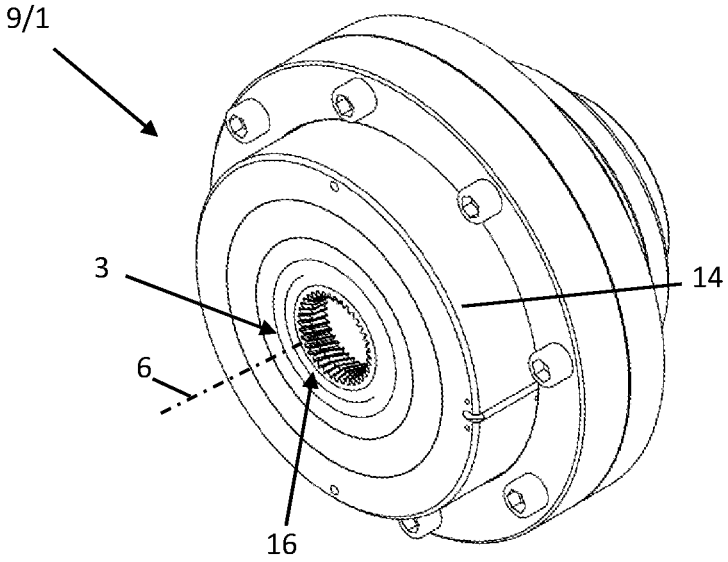
FIG. 2 shows a tool unit of a first design for the forming machine according to FIG. 1, provided with a forming die.
Figure 3:
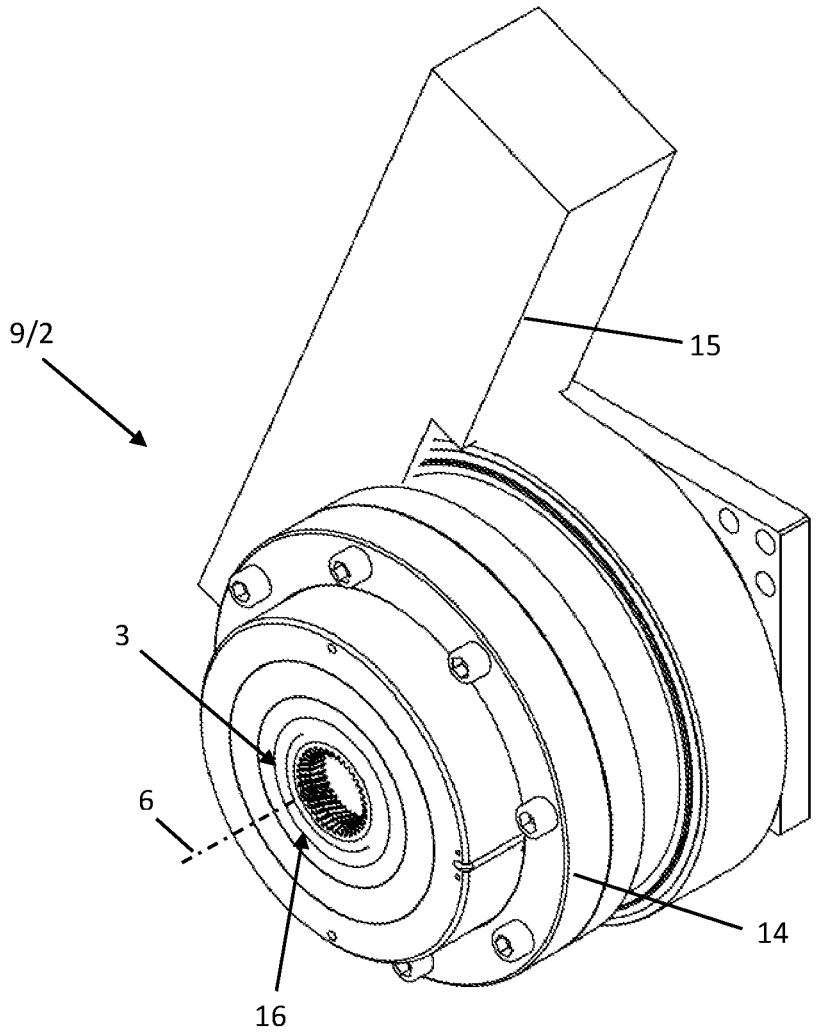
FIG. 3 shows a tool unit of a second design for the forming machine according to FIG. 1, provided with a forming die.

Two drive types are possible for the rotary drive 9 (FIGS. 2 and 3).

In the case of a rotary drive 9/1 (FIG. 2), a tool carrier 14 provided with the forming die 3 is freely rotatable about the axis 6. Deviating therefrom, in the case of a rotary drive 9/2

(FIG. 3) for the tool carrier 14 provided with the forming die 3, a rotary drive motor 15, which is reversible in its direction of rotation, is provided, which motor is drive-connected to the tool carrier 14 by means of a coupling (not shown).

Figure 4A:
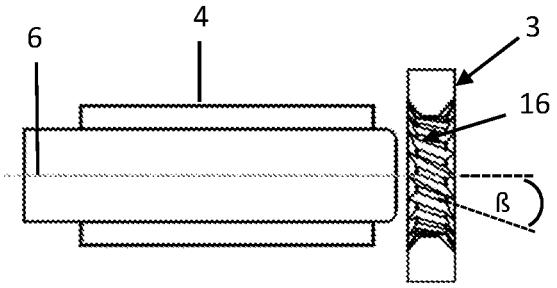
FIGS. 4A and 4B show highly schematic views of the production of an external helical toothing by means of the forming machine according to FIG. 1.

As can be seen in FIGS. 2, 3, and 4A, the forming die 3 has a shaping internal helical toothing 16.

Figure 4B:
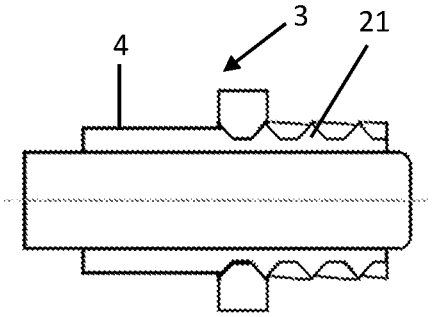

An external helical toothing 21 is produced on the workpiece blank 4 by means of the shaping internal helical toothing 16 of the forming die 3 (FIG. 4B).

For this purpose, the forming die 3, starting from the situation according to FIG. 1, is moved, in the drawing, to the right along the axis 6 by means of the piston-cylinder unit 10 of the feed drive 8 until the forming die 3 runs up onto the end of the workpiece blank 4, which is on the left in the drawing, with a calibration length 17 of the internal helical toothing 16. An axial forming movement of the forming die 3 relative to the workpiece blank 4 now begins. In this case, the frequency generator 11 superimposes an oscillating movement of the forming die 3 along the axis 6 on the axial feed movement of the forming die 3 generated by means of the piston-cylinder unit 10. A forming movement of the forming die 3 positioned on the workpiece blank 4, carried out in the peripheral direction 7 relative to the workpiece blank 4, is superimposed on the axial forming movement, produced in this way, of the forming die 3.

The forming movement of the forming die 3 in the peripheral direction 7 is produced when the rotary drive 9/1 is used, in that, by virtue of the axial forming movement of the forming die 3 and of the workpiece blank 4, the freely rotatably mounted forming die 3 is driven with a rotational movement in the peripheral direction 7 which is carried out relative to the workpiece blank 4. In this case, the forming die 3 consequently forms part of the rotary drive 9/1.

This possibility for producing the component, which extends in the peripheral direction 7, of the resulting forming movement of the forming die 3, relative to the workpiece blank 4, exists because a helix angle β of the shaping internal helical toothing 16 of the forming die 3, which angle is indicated in FIG. 4A and matches the helix angle of the workpiece-side helical toothing to be produced, is correspondingly dimensioned.

The entire forming movement of the forming die 3 relative to the workpiece blank 4 thus results from partial movements.

Due to the oscillating movement of the forming die 3 caused by the frequency generator 11, a return stroke of the forming die 3 is carried out between two forming movements, in each case, carried out by the forming die 3 relative to the workpiece blank 4 in the axial direction 6 and the peripheral direction 7, in which return stroke the forming die 3 is moved back, relative to the workpiece blank 4, counter to the direction of the preceding forming movement, into an already formed region of the workpiece blank 4. The workpiece blank 4 is accordingly formed intermittently. Each of the return strokes of the forming die 3 also has a component in the axial direction 6 and a component in the peripheral direction 7.

When using the rotary drive 9/1, the movement of the forming die 3 in the peripheral direction 7 is produced both during the forming movements and during the return strokes of the forming die 3, due to the interaction of the axial die movement and the helix angle β of the shaping internal toothing 16 of the forming die 3.

Deviating therefrom, when the rotary drive 9/2 is used, the movements carried out by the forming die 3 relative to the workpiece blank 4 in the peripheral direction 7 can also be generated by means of the rotary drive motor 15, which for this purpose can be connected, having different directions of rotation, to the tool carrier 14 via the coupling arranged between the rotary drive motor 15 and the tool carrier 14.

The described processes on the forming machine 1 are controlled by means of a digital machine controller 18 indicated in FIG. 1.

When using the rotary drive 9/1, the digital machine controller 18 is limited, during the forming of the workpiece blank 4, to the control of the feed drive 8. The above-described movements of the die 3 in the peripheral direction 7 are automatically superimposed on the axial movements of the forming die 3 produced by means of the feed drive 8, due to the axial movements of the forming die 3 and the corresponding dimensioning of the helix angle β of the internal helical toothing 16 of the forming die 3.

In combination with the rotary drive 9/2, the digital machine controller 18 can also, by appropriate control of the rotary drive motor 15, control the movements carried out by the forming die 3 relative to the workpiece blank 4 in the peripheral direction 7.

In this case, two different operating modes are conceivable for the rotary drive 9/2.

For this purpose, the rotational movement state of the forming die 3 is detected by means of a detection unit 19 of the digital machine controller 18.

If it is determined by means of the detection unit 19 that the forming die 3 rotates automatically relative to the workpiece blank 4 in the peripheral direction 3 under the action of its axial movement when the rotary drive motor 15 is switched off, and consequently during free rotational mobility of the forming die 3 in the circumferential direction 7, the rotary drive motor 15 remains deactivated.

If, however, it is determined by means of the detection unit 19 of the digital machine controller 18 that the forming die 3 decoupled from the rotary drive motor 15 does not carry out the movements in the peripheral direction 7 or does not carry these out at the required speed, a control signal for the rotary drive motor 15 is generated by the digital machine controller 18, on the basis of which the rotary drive motor 15 is put into operation with the required direction of rotation and then actively generates the component, extending in the peripheral direction 7, of the forming movements of the forming die 3 or the return strokes of the forming die 3.

FIG. 4A shows the conditions during the forming of the workpiece blank 4 immediately before the shaping internal toothing 16 of the forming die 3 runs onto the workpiece blank 4 along the axis 6. FIG. 4B shows the conditions immediately after completion of the forming process. In FIG. 4B, the workpiece blank 4 is provided with the desired external helical toothing 21 over the desired forming length.

Figure 5A:
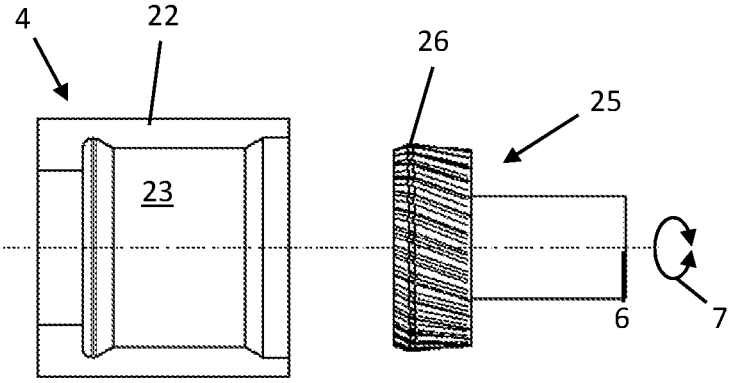
FIGS. 5A and 5B show highly schematic views of the production of an internal helical toothing by means of the forming machine according to FIG. 1.
Figure 5B:
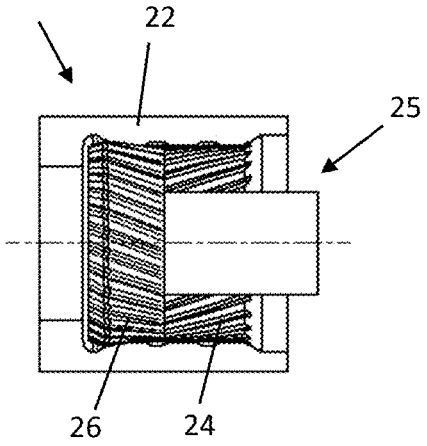

FIGS. 5A and 5B illustrate an application in which an internal helical toothing 24 is produced on a wall 22 of a cylindrical opening 23 of a workpiece blank 4 by means of the forming machine 1.

In this case, a forming mandrel 25 having an external helical toothing 26 is used as the forming tool.

In a manner corresponding to the above-described operations, the feed drive 8 and the rotary drive 9 of the forming machine 1 produce an axial forming movement of the forming mandrel 25 along the axis 6, and also a forming movement of the forming mandrel 25 in the peripheral direction 7 superimposed on the axial forming movement. Both forming movements are superimposed on one another in the described manner, producing a resulting forming movement of the forming mandrel 25 relative to the workpiece blank 4.

In the example shown, the cylindrical opening 23 of the workpiece blank 4 is designed as a blind opening.

After completion of the forming of the workpiece blank 4 (FIG. 5B), the forming mandrel 25, by reversing its movement carried out along the axis 6 and in the peripheral direction 7, is moved out of the interior of the opening 23 now provided with the internal helical toothing 24.

Although only a few embodiments of the present invention have been shown and described, it is to be understood that many changes and modifications may be made thereunto without departing from the spirit and scope of the invention.

What is claimed is:

1. A forming method for producing a helical toothing (21, 24) on a cylindrical workpiece blank (4) by extrusion, the method comprising:

providing a forming machine comprising a rotary drive (9), a machine control (18), and a forming tool (3, 25) having a shaping helical toothing (16, 26), configuring the forming tool (3, 25) and the workpiece blank (4) as forming partners, wherein one of the forming partners is a rotatable forming partner that rotates in a peripheral direction (7) of the workpiece blank (4), and a drive connection between the rotatable forming partner and the rotary drive (9) can be established and released by the machine control (18) such that the rotatable forming partner can, selectively, be freely rotated or driven to rotate by the rotary drive (9), moving the forming tool (3, 25) and the workpiece blank (4) relative to one another in an axial direction (6) with an axial forming movement, producing the helical toothing (21, 24) on the workpiece blank due to the axial forming movement, wherein the forming tool (3, 25) engages, along with the shaping helical toothing (16, 26), in the workpiece blank (4) during the axial forming movement, and superimposing a relative movement of the forming tool (3, 25) and of the workpiece blank (4) carried out in a peripheral direction (7) of the forming tool (3, 25) and of the workpiece blank (4) on the axial forming movement as a forming movement of the forming tool (3, 25) and of the workpiece blank (4) in the peripheral direction (7), wherein the helical toothing (21, 24) is produced on the workpiece blank (4) due to a forming relative movement of the forming tool (3, 25) and of the workpiece blank (4) resulting from the superimposition of the axial forming movement and the forming movement in the peripheral direction, wherein the forming tool (3, 25) engages, along with the shaping helical toothing (16, 26), in the workpiece blank (4) during the resulting forming relative movement of the forming tool (3, 25) and of the workpiece blank (4).

2. The forming method according to claim 1, wherein the helical toothing (21, 24) is produced on the workpiece blank (4) over a forming length, due to the resulting forming relative movement of the forming tool (3, 25) and of the workpiece blank (4), the resulting forming relative movement of the forming tool (3, 25) and of the workpiece blank (4) is divided into resulting forming partial movements of the forming tool (3, 25) and of the workpiece blank (4), wherein the helical toothing (21, 24) is produced on the workpiece blank (4) over a partial length of the forming length during each resulting forming partial movement of the forming tool (3, 25) and of the workpiece blank (4), and the forming tool (3, 25) and the workpiece blank (4) are moved relative to one another, between two successive ones of the resulting forming partial movements, with a backward stroke movement carried out in an opposite direction of the resulting forming partial movements.

3. The forming method according to claim 1, wherein the helical toothing is an external helical toothing (21) produced on the workpiece blank (4), and wherein the forming tool (3) is a forming die and the shaping helical toothing is a shaping internal helical toothing (16), the forming die is positioned on the workpiece blank (4) during the resulting forming relative movement, and due to the resulting forming relative movement, the external helical toothing (21) is produced on the workpiece blank (4) by the forming die engaging along with the shaping internal helical toothing (16) in the workpiece blank (4) during the resulting forming relative movement.

4. The forming method according to claim 1, wherein the helical toothing is an internal helical toothing (24) on a wall (22) of an axially-extending cylindrical opening (23) of the workpiece blank (4), wherein the forming tool (3) is a forming mandrel and the shaping helical toothing is a shaping external helical toothing (26), the forming mandrel axially enters the cylindrical opening (23) of the workpiece blank (4) during the resulting forming relative movement, and due to the resulting forming relative movement, the internal helical toothing (24) is produced on the workpiece blank (4) by the forming mandrel engaging, along with the shaping external helical toothing (26), in the workpiece blank (4) during the resulting forming relative movement.

5. The forming method according to claim 1, wherein the other one of the forming partners is held so as to be rotationally fixed in the peripheral direction (7), and wherein, when the drive connection is released, due to a corresponding dimensioning of a helix angle (B) of the shaping helical toothing (16, 26) of the forming tool (3, 25), and due to the axial forming movement of the forming tool (3, 25), the rotatable forming partner can freely rotate in the peripheral direction (7) by a rotary movement which is carried out relative to the other one of the forming partners, thereby producing the forming movement in the peripheral direction (7).

6. The forming method according to claim 1, wherein the rotary drive (9) is motor-driven.

7. The forming method according to claim 1, wherein the other one of the forming partner is held in a rotationally-fixed manner, during the axial forming movement of the forming tool (3, 25), a rotational movement state of the rotatable forming partner in the peripheral direction (7) is monitored, and the forming movement in the peripheral direction (7) is produced as a function of the monitored rotational movement state of the rotatable forming partner, wherein, the free rotation of the rotatable forming partner is due to the dimensioning of a helix angle of the shaping helical toothing (16, 26) of the forming tool (3, 25), and is due to the axial forming movement of the forming tool (3, 25), the rotatable forming partner rotates in the peripheral direction (7) relative to the other one of the forming partners, and wherein the driven rotation of the rotatable forming partner is motor-driven in the peripheral direction (7) relative to the other one of the forming partners.

8. A forming system for producing a helical toothing by extrusion, comprising:

a cylindrical workpiece blank (4) and a forming machine (1) comprising:

a forming tool (3, 25) having a shaping helical toothing (16, 26), a feed drive (8) configured to move the forming tool (3, 25) and the cylindrical workpiece blank (4) relative to one another in an axial direction (6) with an axial forming movement, wherein the helical toothing (21, 24) of the workpiece is able to be produced on the workpiece blank (4) due to the axial forming movement, wherein the forming tool (3, 25) engages, along with the shaping helical toothing (16, 26), in the workpiece blank (4) during the axial forming movement a rotary drive (9) configured to move the forming tool (3, 25) and the workpiece blank (4) relative to one another in a peripheral direction (7) of the forming tool (3, 25) and of the workpiece blank (4), with thereby providing a forming movement in the peripheral direction (7), and a machine control (18) configured to control the feed drive (8) and the rotary drive (9), wherein the machine control (18) is configured to control the feed drive (8) and the rotary drive (9) in such a way that the forming movement of the forming tool (3, 25) and of the workpiece blank (4) in the peripheral direction (7) is superimposed on the axial forming movement, wherein the helical toothing (21, 24) is able to be produced on the workpiece blank (4) due to a forming relative movement of the forming tool (3, 25) and of the workpiece blank (4) resulting from the superimposition of the axial forming movement and the forming movement in the peripheral direction (7), wherein the forming tool (3, 25) engages, along with the shaping helical toothing (16, 26), in the workpiece blank (4) during the resulting forming relative movement of the forming tool (3, 25) and of the workpiece blank (4), and wherein the forming tool (3, 25) and the workpiece blank (4) are configured as forming partners, one of the forming partners is a rotatable forming partner that rotates in a peripheral direction (7) of the workpiece blank (4), and a drive connection between the rotatable forming partner and the rotary drive (9) can be established and released by the machine control (18) such that the rotatable forming partner can, selectively, be freely rotated or driven to rotate by the rotary drive (9).

9. The forming system according to claim 8, wherein the machine control (18) is configured to control the feed drive (8) and the rotary drive (9) in such a way that:

the helical toothing (21, 24) is produced on the workpiece blank (4) over a forming length, due to the resulting forming relative movement of the forming tool (3, 25) and of the workpiece blank (4), the resulting forming relative movement of the forming tool (3, 25) and of the workpiece blank (4) is divided into resulting forming partial movements of the forming tool (3, 25) and of the workpiece blank (4), the helical toothing (21, 24) is produced on the workpiece blank (4) over a partial length of the forming length during each resulting forming partial movement of the forming tool (3, 25) and of the workpiece blank (4), and the forming tool (3, 25) and the workpiece blank (4) are moved relative to one another, between two successive ones of the resulting forming partial movements, with a backward stroke movement carried out in an opposite direction of the resulting forming partial movements.

10. The forming system according to claim 8, wherein the helical toothing is an external helical toothing (21) produced on the workpiece blank (4), and the forming tool (3) is a forming die, and the shaping helical toothing is a shaping internal helical toothing (16) that can be arranged on the workpiece blank (4), and the machine control (18) is configured to control the feed drive (8) and the rotary drive (9) in such a way that, due to the resulting forming relative movement of the forming die and of the workpiece blank (4), the external helical toothing (21) can be produced on the workpiece blank (4) by the forming die engaging, along with the shaping internal helical toothing (16), in the workpiece blank (4) during the resulting forming relative movement.

11. The forming system according to claim 8, wherein the helical toothing is an internal helical toothing (24) produced on the workpiece blank (4), and the forming tool (3) is forming mandrel and the shaping helical toothing is a shaping external helical toothing (26) configured for axially entering a cylindrical opening (23) of the workpiece blank (4), and the machine control (18) is configured to control the feed drive (8) and the rotary drive (9) in such a way that, due to the resulting forming relative movement of the forming mandrel and of the workpiece blank (4), the internal helical toothing (24) can be produced on a wall of the cylindrical opening (23) of the workpiece blank (4) by the forming mandrel engaging, along with the shaping external helical toothing (26), in the wall of the cylindrical opening (23) of the workpiece blank (4) during the resulting forming relative movement.

12. The forming system according to claim 8, wherein the other one of the forming partners is held so as to be rotationally fixed in the peripheral direction (7), and the rotary drive (9) is configured such that, when the drive connection is released, due to a corresponding dimensioning of a helix angle (β) of the shaping helical toothing (16, 26) of the forming tool (3, 25) and due to the axial forming movement of the forming tool (3, 25), the rotatable forming partner can freely rotate in the peripheral direction (7) by a rotary movement which is carried out relative to the other one of the forming partners, thereby producing the forming movement in the peripheral direction (7).

13. The forming system according to claim 8, wherein the rotary drive (9) comprises a rotary drive motor (15).

14. The forming system according to claim 8, wherein the other one of the forming partners is held so as to be rotationally fixed in the peripheral direction (7), the machine control (18) has a detector (19) configured to detect a rotational movement state of the rotatable forming partner in the peripheral direction (7) during the axial forming movement of the forming tool (3, 25), and the drive connection is between the rotatable forming partner and a rotary drive motor (15) of the rotary drive (9) and can be established or released by means of the machine control (18), as a function of the detected rotational movement state of the rotatable forming partner.

15. A non-transitory computer readable medium that stores a computer program comprising instructions which, when executed by the machine control (18) of the forming system of claim 8, causes the machine control (18) to direct the forming machine (1) to carry out a method for producing the helical toothing (21, 24) on the workpiece blank (4).

* * * * *